US005314300A

United States Patent [19]

Gatley, Jr. et al.

[11] Patent Number: 5,314,300

[45] Date of Patent: May 24, 1994

[54] NOISE CONTROL DEVICE FOR CENTRIFUGAL BLOWER

[75] Inventors: William S. Gatley, Jr.; Bobby D. Garrison, both of Cassville, Mo.

[73] Assignee: Fasco Industries, Inc., Cassville, Mo.

[21] Appl. No.: 820,096

[22] Filed: Jan. 13, 1992

[51] Int. Cl.[5] ..... F04D 29/66

[52] U.S. Cl. ..... 415/119; 415/203

[58] Field of Search ..... 415/203, 204, 206, 119

[56] References Cited

U.S. PATENT DOCUMENTS

| | | | |
|---|---|---|---|
| 353,994 | 12/1886 | Walker et al. | 415/119 |
| 2,107,897 | 2/1938 | McMahan | 415/119 |
| 2,109,742 | 3/1938 | Fanning | 415/119 |
| 2,171,342 | 8/1939 | McMahan | 415/119 |
| 3,477,635 | 11/1969 | Glucksman et al. | 415/119 |
| 3,592,574 | 7/1971 | Zenkner . | |
| 3,687,360 | 8/1972 | Prew et al. . | |
| 4,025,223 | 5/1977 | Anders et al. . | |
| 4,078,870 | 3/1978 | Keller et al. . | |
| 4,182,596 | 1/1980 | Wellman . | |
| 4,412,781 | 11/1983 | Abe et al. . | |
| 4,419,049 | 12/1983 | Gerboth et al. | 415/119 |
| 4,436,481 | 3/1984 | Linder . | |
| 4,439,104 | 3/1984 | Edmonds . | |
| 4,494,908 | 1/1985 | Hopfensperger . | |
| 4,531,356 | 7/1985 | Linder . | |
| 4,573,869 | 3/1986 | Kitamoto . | |
| 4,662,818 | 5/1987 | Hopfenspeger et al. . | |
| 4,680,006 | 7/1987 | Fisher . | |
| 4,705,453 | 11/1987 | Hopfensperger . | |
| 4,712,976 | 12/1987 | Hopfensperger et al. . | |
| 4,761,115 | 8/1988 | Hopfensperger . | |
| 4,844,695 | 7/1989 | Banks et al. . | |

FOREIGN PATENT DOCUMENTS

| | | | |
|---|---|---|---|
| 0118095 | 5/1987 | Japan | 415/119 |
| 0656430 | 8/1951 | United Kingdom | 415/119 |
| 0466983 | 1/1992 | United Kingdom | 415/119 |

*Primary Examiner*—Edward K. Look
*Assistant Examiner*—Mark Sgantzos
*Attorney, Agent, or Firm*—Lorusso & Loud

[57] ABSTRACT

A noise cancellation device for a centrifugal blower comprises a rod mounted in the output of a blower and generally axially parallel to the impeller so that as the impeller rotates, the blades of the impeller sweep past the rod much as in the manner that the blades sweep past the cutoff section of the blower outlet. The rod is positioned a specified distance away the cutoff such that it generates a tone which interferes with the pure tone otherwise generated by the impeller blades sweeping past the cutoff in an out of phase condition to thereby eliminate the pure tone or "spike" normally experienced at a fundamental frequency and harmonics thereof.

1 Claim, 1 Drawing Sheet

NOISE CONTROL DEVICE FOR CENTRIFUGAL BLOWER

BACKGROUND OF THE INVENTION (1) Field of the Invention

The invention relates to centrifugal blowers and is directed more particularly to a blower having means for reducing the operational noise thereof.

(2) Description of the Prior Art

Centrifugal blowers, also known as scroll-type blowers, sirocco blowers, etc., are well known in the art and include a generally cylindrically shaped impeller or blower wheel, having a plurality of blades, the impeller being rotatably mounted within a housing. The blades are oriented in the impeller such that as the impeller is rotated in a specific direction, air is drawn axially into the interior of the impeller and blown radially outwardly by its blades, and then through a tangential output at increased pressure. The tangential outlet is formed in the housing of the blower and includes a sharply radiused edge or cutoff. The cutoff edge is typically positioned closer to the impeller than any other part of the blower housing and defines a sharp separation between the output and the interior of the blower housing. As a result of the impeller rotating at relatively high speeds past the cutoff, an interaction is created therebetween which produces a pure tone, or whistling noise, at a fundamental frequency. This fundamental frequency has been empirically determined as the speed of the blower wheel in RPM divided by 60, multiplied by the number of blades contained in the impeller. In a typical impeller consisting of nine blades operated at 3,433 RPM, the fundamental blade pass frequency, or pure tone frequency, would be 515 Hz. In addition to the fundamental frequency, this particular design would also have a second harmonic tone at 1030 Hz, a third harmonic at 1545 Hz, etc., as is well known in the art. These pure tones represent frequencies of dramatically increased amplitude over the average or "white" noise ordinarily produced by the motor and blower in connection with its rotating action. Also, as is well known, these pure tones of increased amplitude are produced at each of the harmonics, including the third and fourth harmonic, which can generate tones which are particularly annoying to a human ear. For example, a fourth harmonic of the example noted above occurs at approximately 2,060 Hz, which is an ear-piercing sound particularly bothersome at these increased amplitudes. Therefore, there typically is significant design activity and effort expended to eliminate these pure tones. However, the inventors herein are not aware of any ready solution to this problem, until now.

SUMMARY OF THE INVENTION

To solve these and other problems in the prior art, the inventors herein have succeeded in designing and developing a noise control device which effectively cancels the pure tones previously created in a centrifugal blower by revolution of the impeller and movement of the blades past the cutoff. This noise control device essentially comprises a rod which extends parallel to the blades and parallel to the cutoff, the rod being positioned in the output of the blower and generally adjacent the impeller so that the rod generates a noise substantially equal to, but out of phase with, the blade pass noise, or pure tone, created by the cutoff. Although the inventors have utilized a generally cylindrical rod in prototyping the invention, it is believed that other structures would also work, some perhaps better than the rod being utilized. The rod is positioned approximately one-tenth of a wavelength of the fundamental frequency away from the cutoff. This initial position is moderated or adjusted by moving the rod radially outwardly from the impeller, and at the same time edging it closer to the cutoff, so as to minimize its interference with the output air stream from the blower. It is believed that the noise generated by the rod as the blades pass thereby is substantially equal to that produced at the cutoff. However, as the noise wave fronts meet, or interfere with each other, at some point therebetween, they are 180° out of phase so that they effectively cancel one another.

A prototype blower was built and tested with the noise cancellation rod of the present invention and the noise generated thereby was compared with a second blower of the exact same construction but without the noise cancellation rod. A pure tone was measured in the standard production blower at 512 Hz with a 70.3 dB level and a second harmonic at 1024 Hz with a level of 74.6 dB. The noise levels at this fundamental and second harmonic frequencies were "spike" levels which rose substantially above the baseline of average or white noise generated by the blower across the frequency spectrum. The blower which included the noise cancellation rod of the present invention was effective in minimizing the spikes or pure tones experienced in the production blower first tested. For example, at the 512 Hz fundamental frequency, a dB level of 54.1 was measured and at the second harmonic of 1024 Hz, a dB level of 60 was measured. At these two tones, dB levels were reduced by 16.2 and 14.6 dB, respectively. Additionally, it should be noted that the dB levels at these particular frequencies were in line with the dB levels for adjacent frequencies such that no "pure tone" was generated.

While the principal advantages and features of the present invention have been described above, a more complete and thorough understanding of the invention may be attained by referring to the drawings and description of the preferred embodiment which follow.

DETAILED DESCRIPTION OF THE PREFERRED EMBODIMENT

Figure 1:
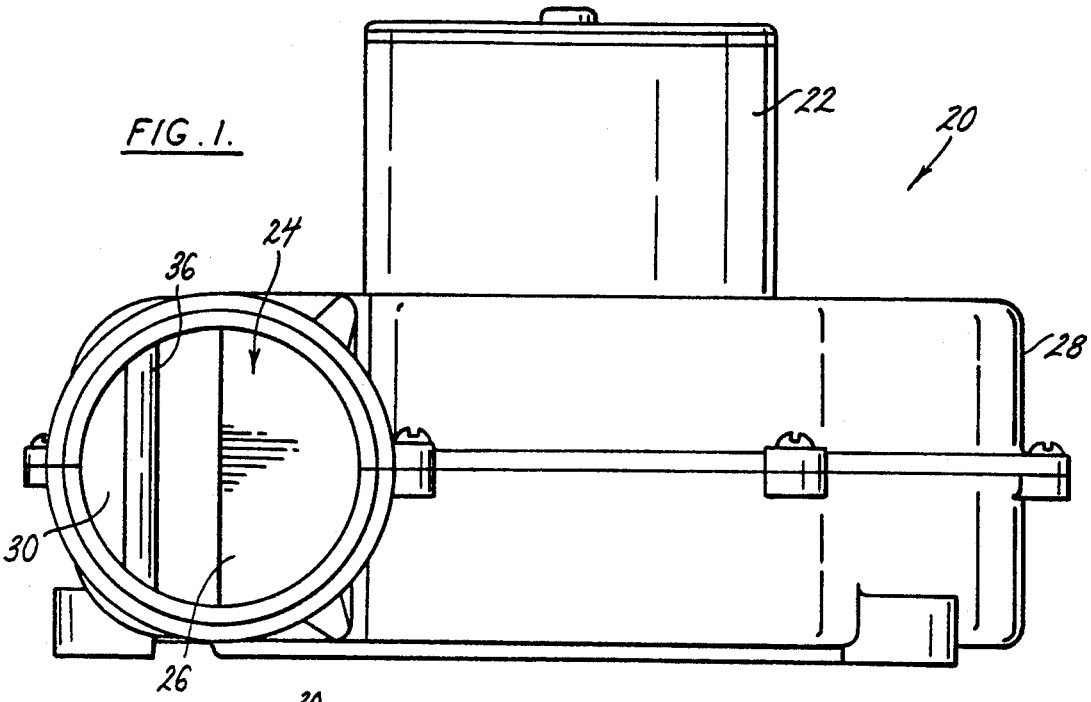
FIG. 1 is a side elevational view of a typical centrifugal blower, looking into the outlet thereof, and illustrating the position of the rod with respect to the impeller.

As shown in FIG. 1, an illustrative centrifugal blower 20 includes a drive motor 22 with an impeller 24 having a plurality of blades 26 fixed thereon and contained within a housing 28. The blower housing 28 has an outlet 30 through which air is blown after being axially drawn in through various openings 32 (see FIG. 2). A cutoff 34 separates the outlet 30 from the rest of the housing 28 and, as shown in FIG. 2, is closely aligned with the edge of the impeller 24, such that as the blades 26 pass thereby, there is a tendency for a pure tone to be generated having a blade pass frequency, as explained above.

In accordance with the teachings of the present invention, a noise cancellation rod 36 is mounted in the outlet 30 of the blower housing 28 and extends generally axially parallel to the impeller 24 and is oriented from the cutoff 34 at a distance approximately equal to one-tenth of the wavelength of the pure tone generated in a blower not having the noise cancellation rod 36 of the present invention. This distance is measured along a chord, from the edge of cutoff 34 to the noise cancellation rod 36.

Figure 2:
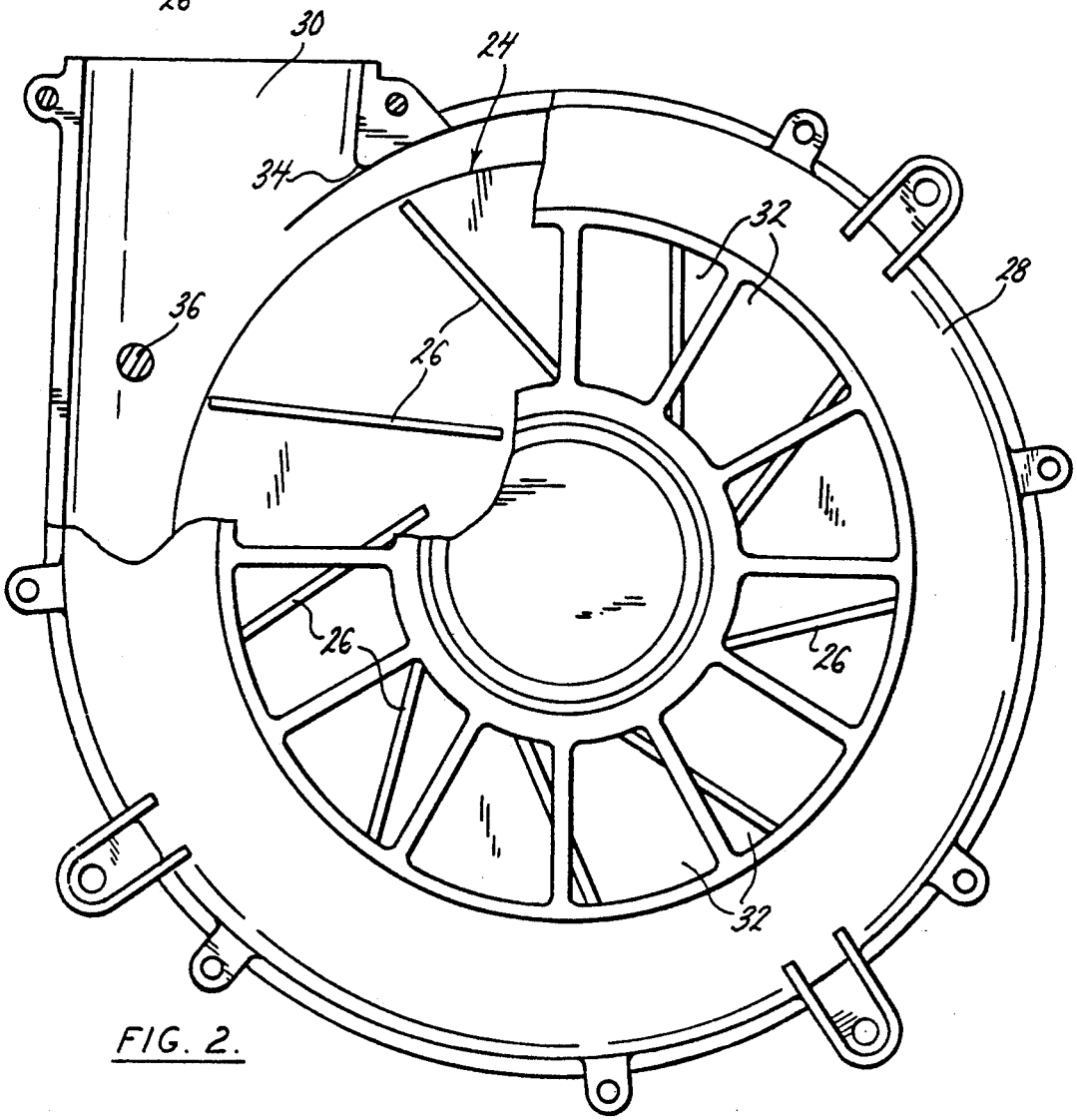
FIG. 2 is a plan view of the centrifugal blower of FIG. 1, partially broken away to further illustrate the placement of the noise cancellation rod with respect to the impeller.

Although the noise cancellation rod 36 is shown in FIG. 2 to be substantially adjacent the impeller 24 and blade 26, a relatively small amount of adjustment in its positioning may be made by moving it radially away from the edge of impeller 24 and closer to cutoff 34 to thereby maintain its ability to generate a noise effectively 180° out of phase with the pure tone, but also present less interference to the normal output of air by the impeller 24 through the output 30.

Although a rod 36 is shown, and the inventors have not tested other shapes or sizes of structure, it is believed that a rod-like shape is not critical to the operation of the present invention and instead other shapes may function equally as well, if not better.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A centrifugal blower having means for blowing air from an inlet to an outlet, said blowing means including a rotatably mounted impeller having a plurality of blades, said inlet being disposed axially of said impeller and said outlet being disposed tangentially of said impeller, said blower including a first stationary structure aligned with said impeller such that as said impeller is rotated said blades sweep past said first stationary structure to create a first noise, said first stationary structure being disposed in said outlet and formed in part by a wall of said outlet, a second stationary structure fixed in said outlet and aligned with said impeller, said second stationary structure comprising a rod fixed at both ends to outlet wall portions, said rod between said ends being adjacent an outlet wall portion opposite from said first stationary structure and having means for creating a second noise combining with said first noise to substantially reduce the intensity of said first noise, said rod being closer to said outlet wall portion opposite from said first stationary structure than to said first stationary structure.

* * * * *